US005391324A

United States Patent [19]

Reinhardt et al.

[11] Patent Number: 5,391,324

[45] Date of Patent: Feb. 21, 1995

[54] AQUEOUS SUSPENSIONS OF PEROXYCARBOXYLIC ACIDS

[75] Inventors: Gerd Reinhardt, Kelkheim; Vera Friderichs, Kesten; Ulrike Rudolf, Hofheim am Taunus, all of Germany

[73] Assignee: Hoechst Aktiengesellschaft, Frankfurt am Main, Germany

[21] Appl. No.: 829,740

[22] Filed: Jan. 31, 1992

[30] Foreign Application Priority Data

Feb. 1, 1991 [DE] Germany ..... 4102970

[51] Int. Cl.[6] ..... C11D 3/33; C11D 3/395; C11D 1/722; C11D 3/39

[52] U.S. Cl. ..... 252/543; 252/174.21; 252/174.22; 252/95; 252/100; 252/173; 252/186.25; 252/186.26; 252/186.42; 252/DIG. 1; 252/DIG. 14

[58] Field of Search ..... 252/174.22, 95, 100, 252/173, 174.21, DIG. 14, DIG. 1, 543, 186.25, 186.26, 186.42, 174.21

[56] References Cited

U.S. PATENT DOCUMENTS

| | | | |
|---|---|---|---|
| 4,399,049 | 8/1983 | Gray et al. | 252/95 X |
| 4,648,987 | 3/1987 | Smith et al. | 252/174.22 X |
| 4,655,781 | 4/1987 | Hsieh et al. | 252/95 X |
| 4,822,510 | 4/1989 | Madison et al. | 252/95 |
| 4,828,747 | 5/1989 | Rerek et al. | 252/95 |
| 4,879,057 | 11/1989 | Dankowski et al. | 252/95 X |
| 5,061,807 | 10/1991 | Gothoffer et al. | 548/473 |
| 5,102,574 | 4/1992 | Russell et al. | 252/174.21 |
| 5,149,463 | 9/1992 | Peterson | 252/174.21 X |

FOREIGN PATENT DOCUMENTS

| | | |
|---|---|---|
| 0325288 | 7/1989 | European Pat. Off. . |
| 0325289 | 7/1989 | European Pat. Off. . |
| 0334404 | 9/1989 | European Pat. Off. . |
| 0337516 | 10/1989 | European Pat. Off. . |
| 0378064 | 7/1990 | European Pat. Off. . |
| 0386566 | 9/1990 | European Pat. Off. . |
| 2253825 | 12/1973 | France . |

OTHER PUBLICATIONS

Kubitschek et al., *Hard Surface Cleaners—II. Performance of Normal and Blended Neodol TM Ethoxylates*, Shell Dev. Co., Jul. 1979.

*Concise Science Dictionary*, 1984, Oxford University Press, Oxford, England, p. 442.

*The Condensed Chemical Dictionary*, 4th ed., 1950, Reinhold Publishing Corporation, N.Y., N.Y., pp. 184, 247, 615, & 641.

*Primary Examiner*—Paul Lieberman
*Assistant Examiner*—Douglas J. McGinty
*Attorney, Agent, or Firm*—Connolly & Hutz

[57] ABSTRACT

Storage-stable aqueous suspensions of organic peracids containing 1 to 50% by weight of a surfactant mixture composed of 1 to 4 parts by weight of a $C_8$–$C_{22}$-fatty alcohol, ethoxylated with 1 to 5 units of ethylene oxide, and 4 to 1 parts by weight of a $C_8$–$C_{22}$-fatty alcohol, ethoxylated with 6 to 25 units of ethylene oxide, and, if appropriate, additionally other customary components.

By using two different surfactants, it is possible to set very different viscosity values in these suspensions, from low viscosity to pasty formulations.

20 Claims, No Drawings

AQUEOUS SUSPENSIONS OF PEROXYCARBOXYLIC ACIDS

DESCRIPTION

The present invention relates to the preparation of storage-stable aqueous suspensions of solid peroxycarboxylic acids and their use in oxidants, bleaches and disinfectants.

In addition to inorganic persalts such as sodium perborate, mono- or tetrahydrate and activator systems based on tetraacetylethylenediamine (TAED), stable organic peroxycarboxylic acids are at present gaining increasing importance as bleaching systems for the detergent and cleaning agent industry.

Application areas for such bleaching systems are pulverulent washing powders, spot removal salts or special cleaners such as curtain or dishwashing liquids, and also denture cleaners. They are additionally an essential constituent of modular construction systems.

Because of inadequate storage stability, organic peroxycarboxylic acids can be employed in pulverulent detergents and cleaners only in the form of stabilized granules. In the case of easily decomposable peroxycarboxylic acids, the incorporation of exothermic control agents is additionally necessary in order to ensure safer handling of the compounds. As peroxycarboxylic acid powders are granulated in most cases, considerable drying costs additionally arise.

On the other hand, the advantage of liquid bleaching and cleaning systems is their simple preparation, in which no cost-intensive processing or drying steps are necessary. The preparation can be carried out in simple plants and in addition peroxycarboxylic acids in the moist state are usually safer to handle than in the dry state.

The prerequisite for commercial use is a physically stable, fluid or pasty suspension of organic peroxycarboxylic acids which can be stored without problems for a relatively long time without noticeable loss of active oxygen.

A number of patent applications for the preparation and use of such bleach suspensions have been published.

Thus, in U.S. Pat. No. 3,996,152 a bleach is described which contains a suspension of a solid peroxycarboxylic acid in a liquid carrier material and a non-starch-containing thickener based on a polymer. The preferred peracid in this case is peroxyazelaic acid. Thickeners based on starch are described in U.S. Pat. No. 4,017,412, but these formulations are prone to phase separation after relatively long storage periods and thus become unusable. Bleach suspensions based on colloidal silicic acid, xanthan or agar polysaccharides are claimed in EP-A 283,791 and 283,792. The peroxycarboxylic acid used is in this case employed in desensitized form.

Pourable peracid formulations without addition of a thickener are described in EP 160,342. In this case, diperoxydodecanedioic acid is suspended in an aqueous medium which contains surfactants and electrolytes (sodium sulfate or nitrate) at pH values between 1 and 6.5. Mixtures of anionic and nonionic surfactants are used as surface-active compounds.

Aqueous, fluid formulations, consisting of peroxydicarboxylic acids and anionic surfactants, in particular alkylbenzenesulfonates, are claimed in EP 176,124. Mixtures of linear alkylbenzenesulfonate and ethoxylated fatty alcohols are preferred as surfactants in EP 201,958. In a similar application (EP 240,481) the aqueous suspension consists of a diperoxycarboxylic acid, alkylbenzenesulfonate, magnesium sulfate and water.

Because of ecological doubts about linear alkylbenzenesulfonate (rate and completeness of biological degradability), more acceptable alkanesulfonates are preferred as anionic surfactants in patent applications EP-A 334,405 and 337,516. They are used in combination with ethoxylated alcohols (EP-A 334,405) or fatty acids (EP-A 337,516).

Suspensions of organic peroxycarboxylic acids in nonionic surfactants having HLB values between 6 and 11 are described in EP-A 386,566.

Apart from a few exceptions, the peroxycarboxylic acid used is diperoxydodecanedioic acid (DPDDA). However, this can only be handled in non-desensitized form with the greatest safety measures.

With the imidoperoxydicarboxylic acids (EP-A 325,228; EP-A 349,940; DE 38 23 172) and the ureidoperoxycarboxylic acids (DE 40 16 980), groups of organic peroxycarboxylic acids have been developed which have a distinctly higher oxidizing and bleaching power than the diperoxydodecanedioic acid used until now. Economically and in terms of application technology, phthalimidoperoxycaproic acid (PAP) and phenylureidoperoxycaproic acid are of particular interest in this connection.

The aim of the present invention was therefore the preparation of fluid or pasty, storage-stable peracid suspensions, in particular those based on imido- and ureidoperoxycarboxylic acids.

The object was achieved by suspending the peracid in an electrolyte-free aqueous mixture of two different nonionic surfactants. Surprisingly, such suspensions are not only physically and chemically stable over a relatively long period, but it is also particularly advantageous that the viscosity of the suspension can be varied within a wide range by a suitable combination of the surfactants. By variation of mixing ratio of the two surfactants, both low viscosity suspensions, such as are used, for example, in multicomponent washing machines, and pasty suspensions can be obtained, which are particularly suitable for specific spot treatment by applying the paste to the fabric. This offers a distinct advantage compared to the suspensions described in EP-A 386,566, where only those ethoxylated fatty alcohols are used whose HLB is between 6 and 11. With these suspensions, a variation in the viscosity of the type which is possible with the suspensions according to the invention cannot be achieved.

The invention relates to storage-stable aqueous suspensions of organic peracids which contain 1 to 50% by weight of a surfactant mixture composed of 1 to 4 parts by weight of a $C_8$–$C_{22}$-fatty alcohol, ethoxylated with 1 to 5 units of ethylene oxide, and 4 to 1 parts by weight of a $C_8$–$C_{22}$-fatty alcohol, ethoxylated with 6 to 25 units of ethylene oxide, and, if appropriate, additionally other customary components.

The essential components of the suspension according to the invention are therefore a peroxycarboxylic acid, a combination of two nonionic surfactants, and, if appropriate, other additional components. These are described in more detail in the following.

The Peroxydicarboxylic Acid

All solid peroxymono- or -dicarboxylic acids which are nearly water-insoluble at pH 2–6 can be employed as peroxycarboxylic acids in the formulations according to the invention. A survey of such peroxycarboxylic acids is given, for example, in U.S. Pat. No. 4,391,724. Those peracids are preferred which are additionally stabilized by means of a specific, heteroatom-containing group in the molecule. Such groups are, for example, amido groups as described in EP-A 170,386 and 290,292, sulfone groups as described in EP-A 267,175 or 334,427, and amino groups as described in EP-A 300,461, 316,809 and 340,754. Particularly preferred, however, are imidoperoxycarboxylic acids as described in EP-A 325,288, 325,289, 349,940 or in DE 38 23 172 and ureidoperoxycarboxylic acids as described in DE 40 16 980.

The concentration of the peroxycarboxylic acid in the formulation according to the invention is 0.5–30%, preferably 3–20%. The particle size of the peroxycarboxylic acid used can be between 0.5 and 1,000 microns. For rapid dissolution in the washing liquor, particle sizes of 0.5–15 microns are to be recommended.

The Surfactant System

The surfactant system for the suspensions according to the invention consists of a combination of a lower ethoxylated fatty alcohol and a medium to higher ethoxylated fatty alcohol. This means that the first surfactant contains 1–5 mol, preferably 2–4 mol, of ethylene oxide, and the second surfactant 6 to 25 mol, preferably 6–12 mol, of ethylene oxide per mol of alcohol. The fatty alcohol itself contains 8–22, preferably 12–18 carbon atoms.

The alcohols present in these surfactants can be of natural or petrochemical origin, and branched or straight-chain. Examples of lower ethoxylated alcohols are the commercial products Genapol UD-030, 050, Genapol C-050, Genapol O-020, 050, Genapol OA-040, Genapol OX-030, Genapol T-050 or Genapol X-030, 050. Examples of medium or higher ethoxylated alcohols are Genapol OA-070, 080, 089, Genapol OX-060, 080, 100, 109, 130, Genapol O-080, 100, 120, 150, Genapol C-080, 100, Genapol UD-079, 080, 088, 110, Genapol T-080, 100, 110, 150, 180 or Genapol X-060, 080, 150. (Genapol is a registered trademark of HOECHST AG). The fatty alcohol radicals of the surfactants can be identical or different.

The mixing ratio of the two surfactants is of crucial importance for the viscosity behavior of the suspensions according to the invention. It can be varied within wide ranges. Mixing ratios of the lower to medium or higher ethoxylated fatty alcohols of 1:4 to 4:1 are preferred. Surfactant mixtures in which the surfactants are present in a ratio of 1:2 to 2:1 are particularly preferred. The viscosity behavior of the suspensions according to the invention is also dependent, however, on their total surfactants content. The content of the surfactants in the aqueous suspension is between 1 and 50%, preferably between 2 and 30%, but in particular between 3 and 25%.

Additional Components

As heavy metal ions catalyze the decomposition of peroxy compounds, the suspension according to the invention can contain complexing agents in order to complex these ions. Examples of such complexing agents are ethylenediaminetetraacetic acid (EDTA), nitrilotriacetic acid (NTA), isoserinediacetic acid, ethylenediaminetetramethylenephosphonic acid (EDTMP), but in particular diethylenetriaminepentamethylenephosphonic acid. The concentration of these compounds can be between 10 ppm and 8%, preferably 0.1–5%. In special applications, for example in the removal of blood-containing stains, a high concentration (i.e. 3–5%) of these substances may be desirable. The compounds can be added in the form of the free acid, partially neutralized or in the form of the salts.

Addition of agents for adjusting the pH may also be necessary, as the formulations have an optimum chemical stability in the acidic pH range, in particular between pH 2 and 6, preferably at pH 3–5.5. To acidify the suspension, all the organic or inorganic acids such as hydrochloric acid, phosphoric acid, sulfuric acid, acetic acid, citric acid or lactic acid can be used, and for alkalization inorganic bases or organic amines.

As other additives, the formulation according to the invention can contain antifoam agents, optical brighteners, perfumes, dyes, antioxidants or hydrogen peroxide.

The peroxycarboxylic acid suspensions according to the invention can be employed in numerous application areas, for example as a detergent additive for textile washing, as a washing power intensifier, in light duty liquids, in cleaners and disinfectants for hard surfaces, and in all-purpose cleaners or acidic abrasive cleaners.

In combination with a liquid or pulverulent detergent, red wine, tea and other bleachable stains are removed without problems at 20°–95° C. during the washing or cleaning process. In particular, the pourable or pumpable suspensions are suitable as a bleach component for use in modern multicomponent washing machines.

The suspensions according to the invention may furthermore be employed as presoaking agents or spot removers. Particularly suitable for this are the high viscosity formulations which can be applied directly to stains. Pasty formulations can be put on the market, for example, in tubes or in the form of sticks.

The suspensions are employed in those concentrations in which the active oxygen content of the washing liquor at the start of the washing process is 0.5–50 ppm, preferably 3–30 ppm, of active oxygen.

EXAMPLES 1–7

Preparation of liquid bleaches based on phthaloylaminoperoxycaproic acid (PAP).

The nonionic surfactants are melted and intensively mixed with one another, and warm water and, if appropriate, additives are added. The mixture is allowed to cool with stirring, then the pH is adjusted to <4 using $H_2SO_4$, and only then is the peroxycarboxylic acid slowly stirred in and the mixture homogenized.

All data in % by weight.

| | Example | | | | | | |
|---|---|---|---|---|---|---|---|
| | 1 | 2 | 3 | 4 | 5 | 6 | 7 |
| $C_{14}/C_{15}$-oxo-alcohol containing 8 units of ethylene oxide | 5 | 5 | 5 | 5 | 6 | 10 | 10 |
| $C_{11}$-oxoalcohol containing 3 units of ethylene oxide | 5 | 5 | 4 | 5 | 5 | 5 | 10 |
| Dequest 2066 [1] | — | — | 1 | 1 | 1 | 0.5 | 2 |
| Comperlan KD ® [2] | — | — | — | — | — | 2 | — |
| Antifoam agent | — | — | — | — | — | 2 | — |
| PAP | 5 | 10 | 15 | 15 | 15 | 15 | 15 |
| distd. water | to 100% | | | | | | |
| Viscosity in mpas: | 200 | 850 | 1100 | 1200 | 1500 | 8000 | highly |

-continued

| | Example | | | | | | |
|---|---|---|---|---|---|---|---|
| | 1 | 2 | 3 | 4 | 5 | 6 | 7 |
| | | | | | | | pasty |

1) Complexing agent
2) Fatty acid alkanolamide (Henkel KGAA)

All of the formulations can be stored for more than 3 months without phase separation being observed. The formulations are also stable in the temperature swing test (−8° C. to +40° C.). The loss of active oxygen after storage for 3 months was at most 15%, determined by iodometric titration before and after storage.

EXAMPLE 8

Washing tests using a formulation as in Example 4.

The bleaching activity of the bleach suspensions according to the invention was checked in washing tests.

The washing tests were carried out in a washing machine (Miele W 723) at 40° C. using water of water hardness 15° German hardness. The main wash time was 30 minutes. 4 g/l of the formulation as in Example 4 were employed. The addition of a separate detergent was omitted.

Red wine on cotton (EMPA, Switzerland), tea on cotton (WFK, Krefeld), tea on polyester/cotton (WFK, Krefeld) and coffee on cotton (WFK, Krefeld) were used as stains. Two each of these test stains were sewn onto a cotton terry towelling towel. In each case, two of these towels were employed per washing operation together with 2 kg of ballast washing.

The brightening of the test stains was determined after washing by reflection measurements.

The washing tests were repeated after 3 months' storage of formulation 4.

For comparison, washing was carried out using a formulation as in Example 4, which, however, contained no peroxycarboxylic acid.

Washing tests with formulation 4
Reflection values measured at 460 nm

| Stain: | new | after 3 months | without peroxycarboxylic acid |
|---|---|---|---|
| cotton-red wine | 75.4 | 73.8 | 53.5 |
| cotton-coffee | 80.8 | 78.6 | 63.5 |
| cotton-tea | 77.2 | 73.6 | 43.9 |
| polyester-cotton-tea | 86.7 | 84.2 | 48.8 |

The washing results verify the bleaching activity of the formulation according to the invention. After a storage time of 3 months, only an insignificant decrease in the bleaching activity is observed.

We claim:

1. A storage-stable aqueous suspension of an organic peracid, wherein the suspension contains 1 to 50% by weight of a surfactant mixture consisting essentially of the components (a) 1 to 4 parts by weight of a $C_8$–$C_{22}$-fatty alcohol, ethoxylated with 1 to 5 units of ethylene oxide, and (b) 4 to 1 parts by weight of an ethoxylated fatty alcohol selected from the group consisting of:

(1) $C_8$–$C_{18}$ fatty alcohol ethoxylated with 8 to 25 units of ethylene oxide, (2) $C_8$–$C_{12}$ fatty alcohol ethoxylated with 6 to 8 units of ethylene oxide, and (3) $C_{18}$–$C_{22}$ fatty alcohol ethoxylated with 12 to 25 units of ethylene oxide, and wherein the suspension contains at least one additional component selected from the group consisting of complexing agents, acid, antifoam agents, optical brighteners, perfumes, dyes, antioxidants and hydrogen peroxide.

2. A suspension as claimed in claim 1, which is adjusted to a pH of 2 to 6.

3. A suspension as claimed in claim 1, which contains a peracid which contains a heteroatom in the molecule.

4. A suspension as claimed in claim 1, which contains an imido- or ureidoperoxycarboxylic acid as the peracid.

5. A suspension as claimed in claim 1, wherein the content of peracid is 3 to 20% by weight.

6. A suspension as claimed in claim 1, wherein a surfactant in the surfactant mixture is derived from a $C_{12}$–$C_{18}$-fatty alcohol.

7. A suspension as claimed in claim 1, wherein the surfactant of component (a) is ethoxylated with 2 to 4 units of ethylene oxide.

8. A suspension as claimed in claim 1, wherein the surfactant of component (b) is ethoxylated with 6 to 12 units of ethylene oxide.

9. A suspension as claimed in claim 1, wherein the surfactant mixture consists essentially of 1 to 2 parts by weight of the surfactant of the component (a) and 2 to 1 parts by weight of the surfactant of component (b).

10. A suspension as claimed in claim 1, wherein the suspension contains 3 to 25% by weight of the surfactant mixture.

11. A storage-stable aqueous suspension as claimed in claim 1, wherein said surfactant mixture consists of the components (a) and (b).

12. Detergents comprising a suspension as claimed in claim 1.

13. Cleaners comprising a suspension as claimed in claim 1.

14. Bleaches comprising a suspension as claimed in claim 1.

15. A suspension as claimed in claim 1, wherein the content of peracid is 0.5 to 30%.

16. A suspension as claimed in claim 1, wherein the peracid has a particle size between 0.5 to 1000 microns.

17. A suspension as claimed in claim 1, wherein the peracid has a particle size between 0.5 to 15 microns.

18. A suspension as claimed in claim 1, wherein the suspension contains 2 to 30% by weight of the surfactant mixture.

19. A suspension as claimed in claim 1, which is adjusted to a pH of 3 to 5.5.

20. A storage-stable aqueous suspension of an organic peracid, wherein the suspension contains 1 to 50% by weight of a surfactant mixture consisting essentially of the components (a) 1 to 4 parts by weight of a $C_8$–$C_{22}$-fatty alcohol, ethoxylated with 1 to 5 units of ethylene oxide, and (b) 4 to 1 parts by weight of an ethoxylated fatty alcohol selected from the group consisting of:

(1) $C_8$–$C_{18}$ fatty alcohol ethoxylated with 8 to 25 units of ethylene oxide, (2) $C_8$–$C_{12}$ fatty alcohol ethoxylated with 6 to 8 units of ethylene oxide, and (3) $C_{18}$–$C_{22}$ fatty alcohol ethoxylated with 12 to 25 units of ethylene oxide.

* * * * *